US009255426B2

(12) United States Patent
Storey

(10) Patent No.: US 9,255,426 B2
(45) Date of Patent: Feb. 9, 2016

(54) INTERIOR DEADBOLT LOCK COVER

(71) Applicant: Larry Storey, Delray Beach, FL (US)

(72) Inventor: Larry Storey, Delray Beach, FL (US)

( * ) Notice: Subject to any disclaimer, the term of this patent is extended or adjusted under 35 U.S.C. 154(b) by 0 days.

(21) Appl. No.: 14/340,541

(22) Filed: Jul. 24, 2014

(65) Prior Publication Data

US 2015/0026926 A1 Jan. 29, 2015

Related U.S. Application Data

(60) Provisional application No. 61/858,109, filed on Jul. 24, 2013.

(51) Int. Cl.

| | |
|---|---|
| ***E05B 13/00*** | (2006.01) |
| ***E05B 17/14*** | (2006.01) |
| *E05B 17/20* | (2006.01) |
| *E05B 17/00* | (2006.01) |
| *E05B 17/18* | (2006.01) |

(52) U.S. Cl.

CPC ..... *E05B 17/14* (2013.01); *E05B 17/00* (2013.01); *E05B 17/18* (2013.01); *E05B 17/20* (2013.01)

(58) Field of Classification Search

CPC ..... E05B 15/02; E05B 17/14; E05B 17/18; E05B 17/00; E05B 17/0095; E05B 17/20; E05B 17/2084; E05B 17/186

USPC ..... 70/54–56, 158–160, 232, DIG. 58, 416, 70/417, 419, 420, 421, 423, 455, 465

See application file for complete search history.

(56) References Cited

U.S. PATENT DOCUMENTS

| | | | | |
|---|---|---|---|---|
| 3,916,654 | A * | 11/1975 | Mudge, Jr. | 70/56 |
| 4,503,692 | A * | 3/1985 | Grint | 70/418 |
| 5,865,050 | A | 2/1999 | Michaud et al. | |
| 6,769,278 | B1 | 8/2004 | Chang | |
| 6,823,627 | B1 | 11/2004 | Ben-Ezra | |
| 6,993,944 | B2 | 2/2006 | Hicks | |
| 7,264,285 | B1 | 9/2007 | Ross | |
| 7,802,828 | B2 | 9/2010 | Hopkins et al. | |
| 7,805,967 | B1 | 10/2010 | Agozzino et al. | |
| 2013/0020802 | A1 | 1/2013 | Ng | |

* cited by examiner

*Primary Examiner* — Suzanne Barrett
*Assistant Examiner* — Morgan McClure
(74) *Attorney, Agent, or Firm* — Bennett Intellectual Property; Allen F. Bennett

(57) ABSTRACT

A deadbolt lock cover is removably attachable to an anchor plate. While a door is opened, the deadbolt lock cover may be removably engaged with the anchor plate by means of bolts and hooks. When the cover has been engaged with the anchor plate and the door is closed, the interior portion of the deadbolt lock, having the manually operable knob, is inaccessible, being completely covered by the deadbolt lock cover. Thus, the deadbolt lock may only be unlocked by using a key on the outside tumbler of the lock. The cover may include a frame for supporting the bolts and may be of a variety of different geometries.

20 Claims, 3 Drawing Sheets

INTERIOR DEADBOLT LOCK COVER

CROSS-REFERENCE TO RELATED APPLICATIONS

This application claims priority to U.S. Provisional Application Ser. No. 61/858,109 filed on Jul. 24, 2014, the contents of which are hereby incorporated by reference in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

1. Field of Endeavor

The present invention relates to devices and methods for preventing intrusion into a building by accessing the interior tumbler of a deadbolt. More particularly, the invention relates to a cover that may be secured over the inside portion of a deadbolt lock, thereby preventing a person from actuating a lever and retracting the deadbolt such that a door may be opened.

2. Background Information

It is well known in the art to provide a door with a deadbolt lock. Such locks are generally provided where security is a concern, such as the door of a home, business, or hotel room. The deadbolt is often mounted above the doorknob that actuates the less secure spring loaded latch. The deadbolt lock is operable by a key on the outside. It may be operable without a key on the inside by a simple knob or lever. This enables escape in an emergency without a key. The knob or lever is elliptical in shape so that a user can visually determine whether the deadbolt is locked or unlocked. The long axis of the ellipse is generally vertical when the bolt is in the locked position. When a person is secure behind a deadbolt locked door, that security may be breached by someone with a key, or someone with means to retract the bolt.

It is advantageous to provide a knob or lever on the inside of a deadbolt lock for ease of use as well as for safety reasons. In an emergency, it is generally preferable for the lock to be opened easily and quickly from the inside. However, this may provide a security risk if there is a window close to the deadbolt lock. An intruder may break the glass of the window and reach inside and twist the lever of the deadbolt lock, thereby permitting access through the locked door.

To prevent an intruder from opening the door by reaching through a broken window, one may use a deadbolt lock that may only be opened or closed with a key on both the inside and the outside. However, this results in the deadbolt lock being considerably more difficult to use.

In view of the foregoing, there is a need to provide a deadbolt lock that may be easily opened from the inside, but may not be easily opened by an intruder. It is therefore desirable to provide a deadbolt lock having an easily operated lever on the inside while also preventing access to the lever by an intruder on the outside of a door.

BRIEF SUMMARY OF THE INVENTION

Accordingly, the primary object of the present invention is to provide a device for preventing intrusion into a building by preventing engagement and actuation of the knob on the interior portion of a deadbolt lock.

In greater detail, the present invention provides a means for covering and blocking access to the knob on the interior portion of a deadbolt lock when the door is otherwise locked. The invention prevents removing of the deadbolt from the locked position by any means other than use of a key on the tumbler located on the exterior portion of the deadbolt lock.

In one embodiment, the deadbolt lock cover comprises a cover having a top wall and one or more side walls, a frame, and one or more bolts protruding from the frame. The invention also includes an anchor plate having one or more hooks for removable engagement with the bolts of the frame. The bolts and hooks may only be disengaged such that the deadbolt lock cover may be removed from its position blocking access to the interior portion of the deadbolt lock when the door has been opened. As a result, the deadbolt lock may not be moved into the unlocked position without use of a key on the exterior of the deadbolt lock.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
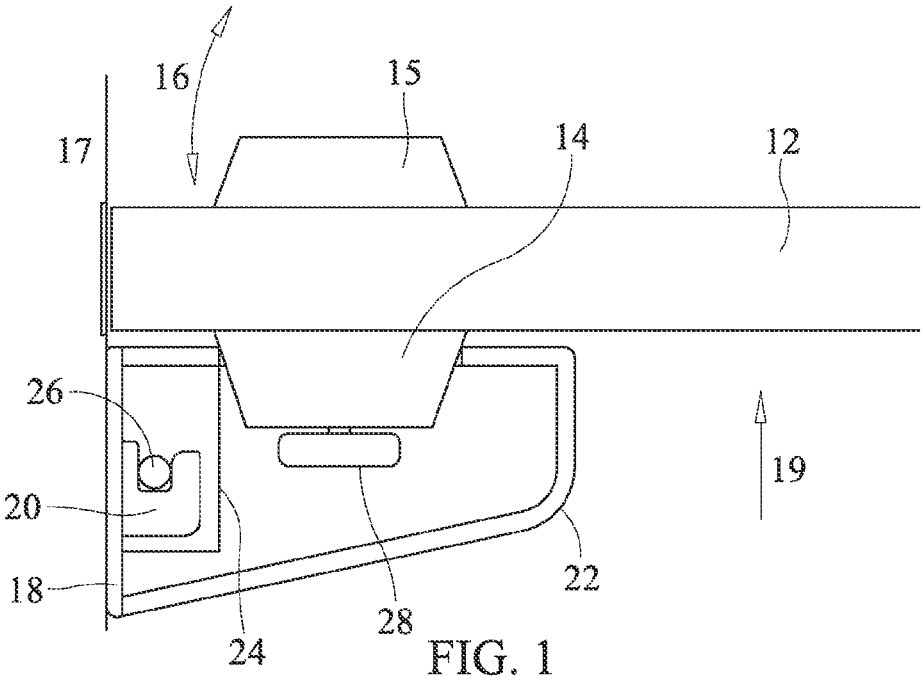
FIG. 1 is a cross-sectional environmental view of a deadbolt lock cover in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a deadbolt lock cover that may be secured into place such that the lever on the interior of a deadbolt lock may be inaccessible.

In greater detail, a cover for the interior of a deadbolt lock may be secured to an anchor plate adjacent to the door. Once the cover is secured to the anchor plate, the interior deadbolt latch may be inaccessible.

FIG. 1 shows a cross section of an interior deadbolt lock cover 10 in accordance with the principles of the invention. A lock cover may include a shell 22 having an interior frame 24. The frame supports the shell and one or more bolts 26. An anchor plate 18 may be affixed to a wall 17 adjacent to a doorjamb. The anchor plate 18 may include one or more hooks 20 which may engage bolts 26 of the frame 24. A door 12 swings open and shut along directional arrow 16. When the door 12 is shut, the interior portion of a deadbolt lock 14 and the knob 28 are covered by the shell 22, such that they are inaccessible. The only way to detach the lock cover shell 22 from the anchor plate 18 is to push the shell 22 in the direction of arrow 19, which requires that the door be opened. Thus, there is no means to open the door without use of the key to the deadbolt.

When a user desires to use the deadbolt lock cover 10, he or she may swing the door 12 open. The shell 22 may then be engaged with the anchor plate 18 by engaging the bolts 26 with the hooks 20 and pushing the shell 22 in a direction opposite to arrow 19. As a result, the shell 22 engages the anchor plate 18 securely. Next, the door 12 is shut such that it lies flush with the doorjamb 17. A key may then be used to engage the deadbolt and lock the door 12. When the door 12 is locked shut, the shell 22 completely covers the interior of the deadbolt lock 14. The interior deadlock cover 10 in accordance with the principles of the invention, when used in this manner, securely locks the door 12 such that the only means for unlocking the door 12 is by using a key with the exterior of the deadbolt lock 15.

Figure 2:
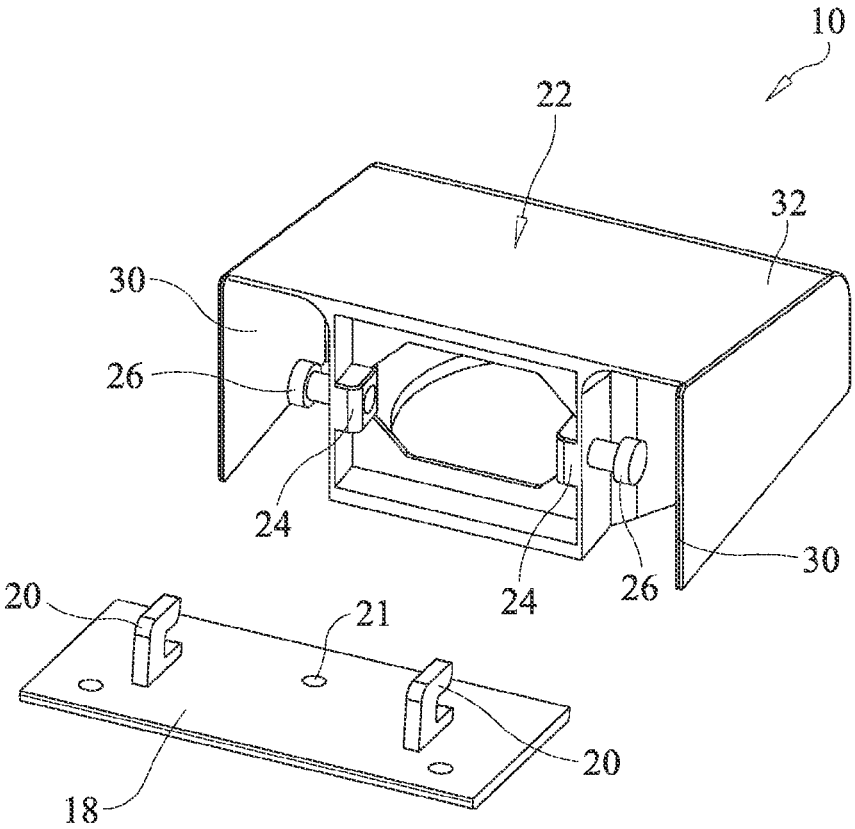
FIG. 2 is a perspective view of a deadbolt lock cover and anchor plate in accordance with the principles of the invention.

FIG. 2 shows the shell 22 and the anchor plate 18 disengaged from one another and with anchor plate 18 not attached to a wall. In this embodiment, anchor plate 18 may include two hooks 20 and three screw holes 21. Screw holes 21 may be used to affix the anchor plate 18 to a wall adjacent to a doorjamb.

Shell 22 may include two sidewalls 30 on each end of the top wall 32. Sidewalls 30 and top wall 32, substantially cover the interior side of a deadbolt lock and knob. In this embodiment, the shell 22 is substantially rectangular with the top wall 32 being curved. However, the shell 22 may be any of a variety of geometric configurations so long as it substantially covers and prevents access to the interior side of a deadbolt lock. For example, the side walls 30 and the top wall 32 may be replaced with a single curved wall that forms a hemispherical shape, or may be of other configurations.

In FIG. 2, the frame 24 of the deadbolt lock shell 22 may also be seen. Frame 24 supports one or more bolts 26 that may engage hooks 20 in order to securely affix the deadbolt covering shell 22 to the anchor plate 18. Other mechanisms may be used in place of the hooks and bolts. For example, the hooks 20 and bolts 26 may be reversed, such that the anchor plate has bolts and the frame has hooks. Other mechanisms may also be suitable so long as they require the cover to slide in relation to the plate in a direction toward the door in order to disengage the cover from the anchor plate.

Figure 3:
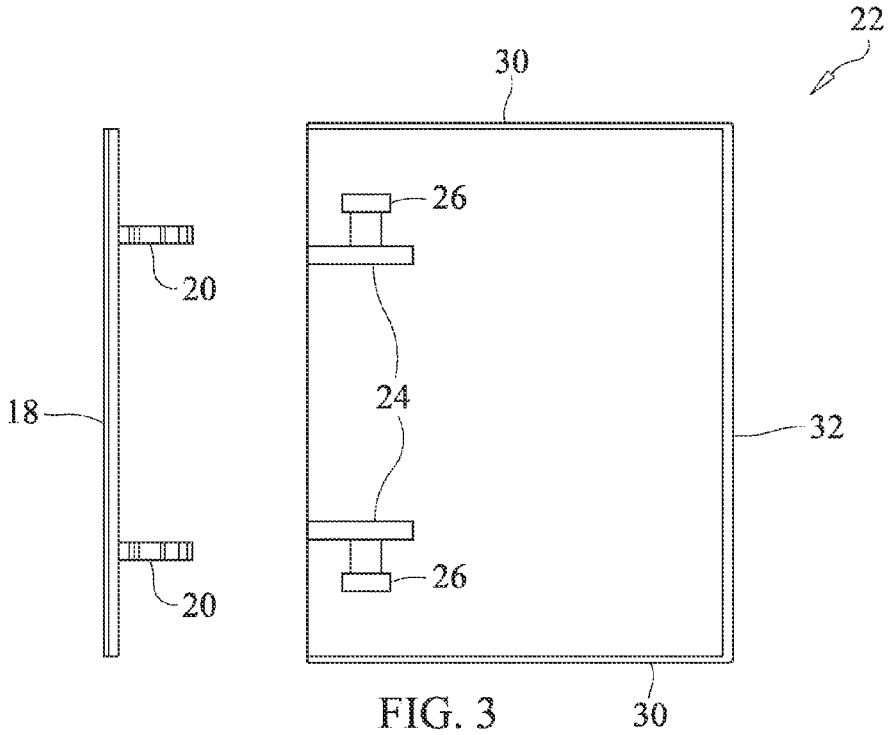
FIG. 3 is another cross-sectional view of a deadbolt lock cover and anchor plate in accordance with the principles of the invention.

FIG. 3 shows a cross-section of an interior deadbolt lock covering shell 22. Top wall 32 curves so as to form an end wall. Together with sidewalls 30, top wall 32 conceals the entire interior portion of a deadbolt lock. Bolts 26 protrude from frame 24 and are designed to engage hooks 20 which protrude from anchor plate 18.

Figure 4:
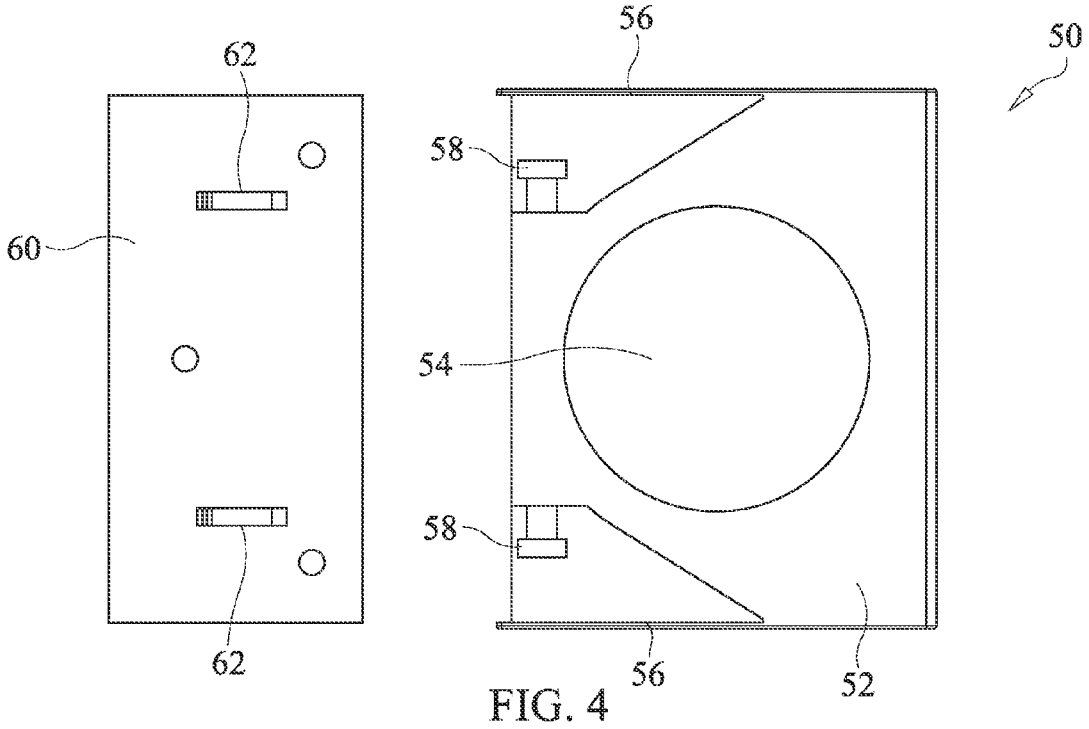
FIG. 4 is a perspective view of an alternative embodiment of a deadbolt lock cover and anchor plate in accordance with the principles of the invention.

In another embodiment, shown in FIG. 4, an interior deadbolt lock covering shell 50 is removably attachable to anchor plate 60 in accordance with the principles of the invention. Deadbolt lock covering shell 50 includes a top wall 54 and two side walls 56 that together cover the interior of a deadbolt lock. Frame 52 includes two bolts 58, for attachment to hooks 62 of the anchor plate 60. In this embodiment, frame 52 is more extensive than the frame shown in FIGS. 1-3. So long as a frame provides sufficient room in which to house and contain the interior of a deadbolt lock, the frame 52 may be of any configuration.

Figure 5:
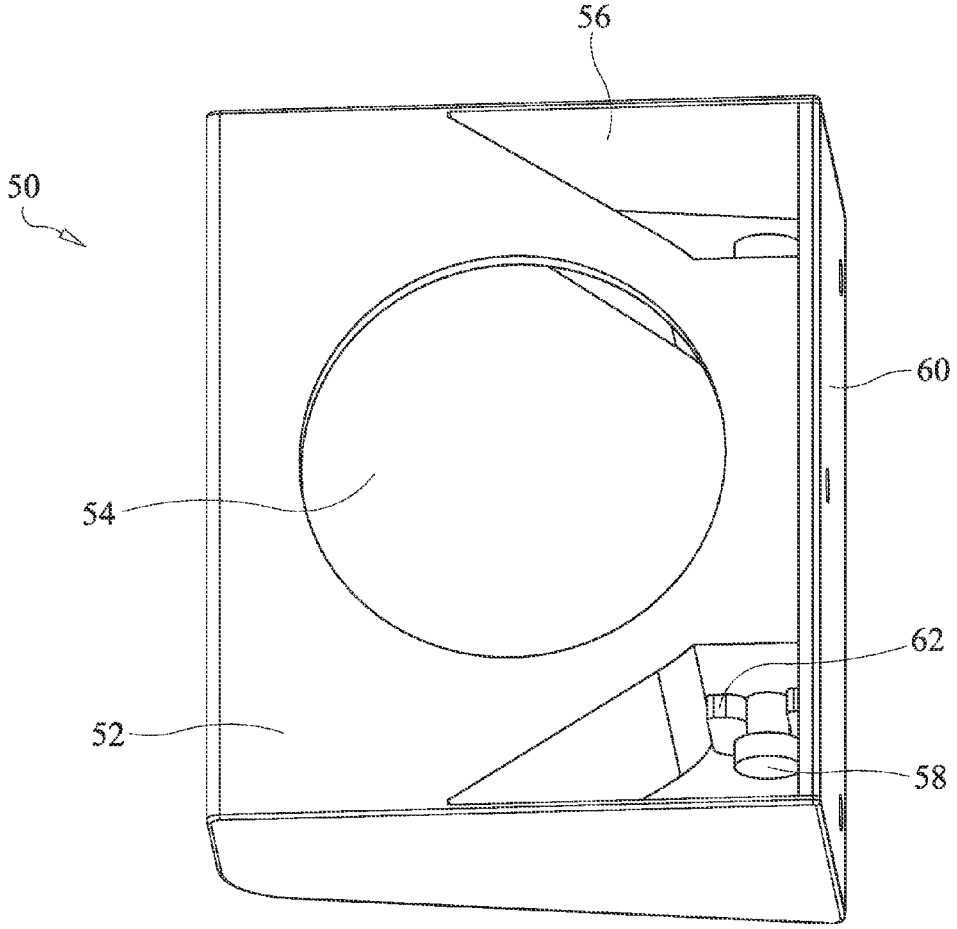
FIG. 5 is a perspective view of an alternative embodiment of a deadbolt lock cover engaged to an anchor plate in accordance with the principles of the invention.

FIG. 5 shows the interior deadbolt lock covering shell 50 engaged with anchor plate 60. In this figure, it may be seen how bolt 58 engages hook 62. When the anchor plate 60 is a fixed to a wall adjacent to a door, and the shell 50 is engaged with the anchor plate 60, the deadbolt lock cover may be secured over the anterior portion of a deadbolt lock such that it is not possible to utilize the knob and withdraw the bolt from the doorframe. Thus, the door may be unlocked only by using a key on the exterior deadbolt lock.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. An interior deadbolt lock cover comprising:

an anchor plate having one or more hooks;

a shell having a frame, the frame having one or more bolts;

wherein the anchor plate is affixed to a wall adjacent to a doorjamb for a door having a deadbolt;

wherein the door is opened by swinging in a first direction and shut by swinging in a second direction, the first direction and the second direction being opposite of one another;

wherein the one or more bolts of the shell engage the one or more hooks of the anchor plate by sliding the shell alongside the anchor plate in the second direction and disengage the hooks of the the anchor plate by sliding the shell in the first direction; and wherein the shell covers the deadbolt of the door when the one or more bolts are engaged with the one or more hooks of the anchor plate such that the deadbolt lock is inaccessible.

2. The interior deadbolt lock cover of claim 1 wherein the one or more hooks comprise two hooks and the one or more bolts comprise two bolts.

3. The interior deadbolt lock cover of claim 1 wherein the shell comprises a top and two sidewalls on each side of the top.

4. The interior deadbolt lock cover of claim 3 wherein the top wall is curved.

5. The interior deadbolt lock cover of claim 4 wherein the one or more hooks comprise two hooks and the one or more bolts comprise two bolts.

6. The interior deadbolt lock cover of claim 1 wherein the shell comprises a single curved wall having a hemispherical shape.

7. The interior deadbolt lock cover of claim 6 wherein the one or more hooks comprise two hooks and the one or more bolts comprise two bolts.

8. An interior deadbolt lock cover comprising:

an anchor plate having one or more bolts;

a shell having a frame, the frame having one or more hooks;

wherein the anchor plate is affixed to a wall adjacent to a doorjamb for a door having a deadbolt;

wherein the door is opened by swinging in a first direction and shut by swinging in a second direction, the first direction and the second direction being opposite of one another;

wherein the one or more hooks of the shell engage the one or more bolts of the anchor plate by sliding the shell slides alongside the anchor plate in the second direction and disengage the hooks of the anchor plate by sliding the shell in the first direction; and wherein the shell covers the deadbolt of the door when the one or more bolts are engaged with the one or more hooks of the anchor plate such that the deadbolt lock is inaccessible.

9. The interior deadbolt lock cover of claim 8 wherein the one or more hooks comprise two hooks and the one or more bolts comprise two bolts.

10. The interior deadbolt lock cover of claim 8 wherein the shell comprises a top and two sidewalls on each side of the top.

11. The interior deadbolt lock cover of claim 10 wherein the top wall is curved.

12. The interior deadbolt lock cover of claim 11 wherein the one or more hooks comprise two hooks and the one or more bolts comprise two bolts.

13. The interior deadbolt lock cover of claim 8 wherein the shell comprises a single curved wall having a hemispherical shape.

14. The interior deadbolt lock cover of claim 13 wherein the one or more hooks comprise two hooks and the one or more bolts comprise two bolts.

15. A method for covering an interior deadbolt lock comprising:

affixing an anchor plate adjacent to a wall adjacent to a doorjamb of a door having a deadbolt lock, the anchor plate having one or more hooks, wherein the door is opened by swinging in a first direction and shut by swinging in a second direction;

providing a shell having a frame having one or more bolts;

engaging the one or more hooks of the anchor plate with the one or more bolts of the shell by sliding the shell alongside the anchor plate in the second direction;

shutting the door by swinging the door in the second direction such that the deadbolt lock is covered by the shell such that the deadbolt lock is inaccessible.

16. The method for covering an interior deadbolt lock of claim 15 wherein the one or more hooks comprise two hooks and the one or more bolts comprise two bolts.

17. The method for covering an interior deadbolt lock of claim 15 wherein the shell comprises a top and two sidewalls on each side of the top.

18. The method for covering an interior deadbolt lock of claim 17 wherein the top wall is curved.

19. The interior deadbolt lock cover of claim 15 wherein the shell comprises a single curved wall having a hemispherical shape.

20. The interior deadbolt lock cover of claim 19 wherein the one or more hooks comprise two hooks and the one or more bolts comprise two bolts.

* * * * *